US008037631B2

(12) United States Patent
Harris

(10) Patent No.: US 8,037,631 B2
(45) Date of Patent: Oct. 18, 2011

(54) DISPLAY PANEL MOUNTING SYSTEM AND METHOD

(75) Inventor: Rod Harris, McLean, VA (US)

(73) Assignee: Truck Ads, LLC, McLean, VA (US)

( * ) Notice: Subject to any disclaimer, the term of this patent is extended or adjusted under 35 U.S.C. 154(b) by 312 days.

(21) Appl. No.: 12/483,397

(22) Filed: Jun. 12, 2009

(65) Prior Publication Data

US 2010/0146833 A1 Jun. 17, 2010

Related U.S. Application Data

(63) Continuation-in-part of application No. 11/798,208, filed on May 11, 2007.

(51) Int. Cl.
*G09F 3/08* (2006.01)

(52) U.S. Cl. ..... 40/662; 24/584.1; 248/205.3

(58) Field of Classification Search ..... 40/662, 40/667, 590, 603; 24/304, 584.1, 586.1, 24/DIG. 38, DIG. 41, DIG. 51, DIG. 52; 403/331, 265; 248/223.41, 224.61, 683, 248/205.3

See application file for complete search history.

(56) References Cited

U.S. PATENT DOCUMENTS

| | | | | |
|---|---|---|---|---|
| 3,372,503 | A | 3/1968 | Weeks | |
| 3,632,071 | A * | 1/1972 | Cameron et al. | 248/74.3 |
| 4,039,134 | A * | 8/1977 | Redmer | 248/205.3 |
| 6,286,238 | B1 | 9/2001 | Harrington | |
| 6,393,746 | B1 | 5/2002 | Jacobson | |
| 6,460,280 | B1 | 10/2002 | Haines-Woon | |
| 6,904,709 | B2 | 6/2005 | Craig et al. | |
| 2001/0008687 | A1 | 7/2001 | Kollaja et al. | |
| 2004/0231208 | A1 | 11/2004 | Pitt | |
| 2006/0070282 | A1 | 4/2006 | Craig et al. | |
| 2006/0207141 | A1 | 9/2006 | Pitt et al. | |

OTHER PUBLICATIONS

Federal Highway Administration, Dot, p. 279-280, Section 658.15.
TruckAds Frame installation Manual, pp. 1-10, Dec. 21, 2006.

* cited by examiner

*Primary Examiner* — Joanne Silbermann
(74) *Attorney, Agent, or Firm* — Bacon & Thomas, PLLC

(57) ABSTRACT

A display mounting kit, system, and method are disclosed utilizing first and second primary releasable attachment elements that are secured about the periphery of a display panel and in a substantially corresponding relationship on a mounting surface, respectively. At least one supplementary fastening element having two interlocking component pieces for selective engagement with each other provides secure mounting between the display panel and the mounting surface. The at least one supplementary fastening element can also be utilized as a stand-alone primary fastening element.

17 Claims, 9 Drawing Sheets

DISPLAY PANEL MOUNTING SYSTEM AND METHOD

This application is a continuation-in-part of prior application Ser. No. 11/798,208, filed May 11, 2007.

FIELD OF THE INVENTION

The present invention relates generally to the field of display panels, and more particularly to a display panel mounting system and method.

BACKGROUND

In the present commercially competitive environment, product placement and awareness have become paramount to success in any given field. To promote product awareness, many companies have utilized banner ads on the Internet. While Internet advertising has certainly increased in the past decade and a half, print advertising in the form of banner ads and billboards remains a staple of many advertising campaigns.

One frequently untapped or overlooked asset for banner ad space is the vertical sides of load-carrying or passenger freight vehicles. Currently, many of these vehicles have substantially vertical sides that are unadorned, or carry minimal information, such as small company logos. These vehicle sides are extensively exposed to the sight of the general public since these vehicles travel across the country and through urban and suburban centers where the general public is also utilizing the same roads for their own purposes. In urban and suburban centers, pedestrians are also exposed to the numerous vehicles that pass through on city streets.

While there are a few existing systems that are designed to transform the side of a vehicle into advertising space, these existing systems have numerous drawbacks. Many of the existing systems require complicated structural frames that are mounted to the exterior of the vehicle. Such frames tend to be bulky and to have considerable weight. Typically, extensive modification to the vehicle is required prior to the use of such a frame. For example, numerous rails, mounting brackets, and mechanical fasteners are required in order to mount a banner ad display panel to the side of a vehicle.

An alternative mounting system that does not require the addition of a bulky and complicated structural frame to the exterior of a vehicle is disclosed in U.S. Pat. No. 6,904,709, granted Jun. 14, 2005, and herein incorporated by reference. The mounting system includes corresponding reclosable fasteners mounted to the vehicle sidewall and around the perimeter of the display panel. While this system is an improvement over the previous structural frame systems, it does not provide the same level of security as the structural frame systems. Due to the reclosable nature of the fasteners, there is the possibility that the fasteners will untimely separate under external forces such as wind and vehicle vibrations.

Accordingly, a supplementary fastening system to increase the security of the mounting system of the '709 patent may be provided in order to prevent the banner or display panel from flying off of a moving vehicle, or from being torn off of a mounting surface due to high wind. An example of such a supplementary fastening system is described in U.S. publication no. 2006/0070282, published Apr. 6, 2006, and herein incorporated by reference.

The supplementary fastening system of the '282 publication includes a fastening device composed of two parts. The first part has a surface that is attached to the sidewall of a vehicle. A protruding stem extends from an opposing surface of the first part. The stem protrudes through an aperture in the display panel and is received within a retaining member. The retaining member has flared edges that extend beyond the aperture in the display panel in order to engage the surface of the display panel.

There are a number of problems associated with the structure of the supplementary fastening device of the '282 publication. One of the problems relates to the fact that the protruding stem of the first part extends away from the vehicle sidewall. U.S. federal regulations promulgated by the U.S. Department of Transportation place a maximum width for vehicles traveling on the national network of interstate highways to be 102.36 inches or less (23 C.F.R §658.15). Most modern box trailers and trucks are built to be 102 inches in width in order to maximize the amount of cargo capacity while staying within the legal width proscribed by the government. When the supplementary fastening device of the '282 publication is placed on both sides of trailers and vehicles that are designed to be 102 inches in order to fit just within the federal standards, the width of the vehicle or trailer increases to greater than the 102.36 inches allowed by law. Thus, use of the supplementary fastening device of the '282 publication may be illegal in some situations.

Further, due to the flared edges of the retaining member, the supplementary fastening device of the '282 publication has a tendency to damage display panels. With the standard vinyl and other plastic display panels, the flared edges of the retaining member actually cut through the display panel, thus rendering the supplementary fastening device of the '282 publication ineffective.

Thus, an improved display panel mounting system, kit, and method are disclosed herein that overcome these and other disadvantages of the prior display panel mounting systems, as will be more fully recognized in view of the following disclosure and appended drawing Figures.

SUMMARY

In accordance with the foregoing discussion, an improved display mounting system, kit, and method are described, wherein the disadvantages of previous display mounting systems are avoided.

In one embodiment of the present disclosure, a display panel mounting system includes a first primary releasable attachment element for placement in a first pattern about a periphery of the display panel. A second primary releasable attachment element is provided for placement on a mounting surface. The second primary releasable attachment element is provided in a second pattern, which substantially corresponds to the first pattern. The second primary releasable attachment element is selectively engageable with the first primary releasable attachment element to define a frame for mounting a display panel to a mounting surface. At least one supplementary fastening element having a stiff core is provided. The at least one supplementary fastening element has first and second substantially planar surfaces for respective engagement with the display panel and the mounting surface and acts as a spacer and provides secure supplementary mounting between a display panel and a mounting surface. The at least one supplementary fastening element may have a thickness between the first and second surfaces in the range of about 1/16 to 3/8 of an inch. In one variation, a plurality of supplementary fastening elements is provided for placement about the periphery of the display panel adjacent to the first and second primary releasable attachment elements.

In order to secure the at least one supplementary fastening element to both the display panel and the mounting surface, adhesive is provided on each of the first and second surfaces. In a variation, the adhesive is a double-sided tape adhesive. In a further variation, the adhesive is a very high bond adhesive.

In order to perform the selective engagement between the first and second primary releasable attachment elements, the first and second primary releasable attachment elements are lengths of a substrate that includes a plurality of periodically spaced interlocking posts, wherein the first and second primary releasable attachment elements are selectively and releasably interlocked with each other to define a frame to mount a display panel to a mounting surface.

In another embodiment of the present disclosure, a display panel mounting kit includes a first primary releasable attachment element arranged for placement in a first pattern about a periphery of the display panel. A second primary releasable attachment element is arranged for placement in a second pattern, substantially corresponding to the first pattern, on a mounting surface. The second primary releasable attachment element is configured for selective engagement with the first primary releasable attachment element to define a frame for mounting a display panel to a mounting surface. At least one supplementary fastening element having a stiff core is provided. The at least one supplementary fastening element has first and second substantially planar surfaces arranged for respective engagement with the display panel and the mounting surface and acts as a spacer and provides secure supplemental mounting between a display panel and a mounting surface. The at least one supplementary fastening element may have a thickness between the first and second surfaces in the range of about 1/16 to 3/8 of an inch.

In one variation, a plurality of supplementary fastening elements are provided for placement about the periphery of the display panel adjacent to the first and second primary releasable attachment elements. In another variation, a portion of the plurality of supplementary fastening elements are provided for placement about the periphery of the display panel adjacent to the first and second primary releasable attachment elements and the remaining portion of the plurality of supplementary fastening elements are provided for placement along a middle portion of the display panel.

In order to secure the at least one supplementary fastening element to both the display panel and the mounting surface, adhesive is provided on each of the first and second surfaces. In a variation, the adhesive is a double-sided tape adhesive. In a further variation, the adhesive is a very high bond adhesive.

In order to perform the selective engagement between the first and second primary releasable attachment elements, the first and second primary releasable attachment elements are lengths of a substrate that includes a plurality of periodically spaced interlocking posts, wherein the first and second primary releasable attachment elements are selectively and releasably interlocked with each other to define a frame to mount a display panel to a mounting surface. In a variation, the number of supplementary fastening elements is related to the size of the display panel.

In a further variation, the kit includes at least one packet of activating wipes for promoting adhesion between the first and second primary releasable attachment elements and the display panel and the mounting surface, respectively.

In another embodiment of the present disclosure, a method of mounting a display panel onto a substrate includes securing a first primary releasable attachment element in a first pattern about a periphery of a display panel. The method further includes securing a second primary releasable attachment element in a second pattern on a mounting surface, substantially corresponding to the first pattern. The method further includes securing a first substantially planar surface of at least one supplementary fastening element having a stiff core to the substrate. The method further includes engaging the first and second primary releasable attachment elements to form a frame for mounting a display panel to a substrate. Lastly, the method includes securing a second substantially planar surface of the at least one supplementary fastening element to the display panel, wherein the at least one supplementary fastening element acts as a spacer element and provides secure supplemental mounting between a substrate and a display panel.

In a variation, the method includes securing a plurality of supplementary fastening elements having first and second substantially planar surfaces to the substrate and the display panel, respectively. In a variation, the method includes securing the plurality of supplementary fastening elements about the periphery of the display panel, adjacent to the first and second primary releasable attachment elements. In a further variation, a portion of the plurality of supplementary fastening elements are secured about the periphery of the display panel and the remaining portion are secured along a middle portion of the display panel.

In further variations, a component piece of a fastening element, a fastening element having first and second component pieces, and a display panel mounting system utilizing a fastening element having first and second component pieces are discussed.

The fastening element for use in a mounting system includes first and second selectively engageable component pieces, wherein each component piece includes a base structure having a first thickness, a tongue structure positioned along a first side thereof and a groove structure positioned along a second side thereof, a substantially planar first face extending between the first and second sides and an opposed second face extending between the first and second sides, and the second face carries first and second connection structures.

Directional indicia can be positioned along the respective second sides of the component pieces.

Each first connection structure can include a reduced thickness portion defined along the respective second face, a first projection positioned along the reduced thickness portion, and a second projection positioned on the first projection.

Each second connection structure can include an increased thickness portion defined along the respective second face, a receiving portion defined in the increased thickness portion, a receiving groove defined in a bottom portion of the receiving portion, and a translating groove defined in the increased thickness portion. Each increased thickness portion can be defined along the respective second face between opposed cutout sections defined in the respective base structure.

Each component piece can also include first and second opposed ramp surfaces defined on the respective first projection, and first and second opposed ramp surfaces defined on the respective second projection.

An attachment mechanism can be carried on each first face of the respective component pieces for engagement with a display panel or a mounting surface.

The numerous advantages, features and functions of the various embodiments of the display mounting system, kit, and method will become readily apparent and better understood in view of the following description, appended claims, and accompanying drawings. The following description is not intended to limit the scope of the display mounting system, kit, and method, but instead merely provides exemplary embodiments for ease of understanding.

Figure 1:
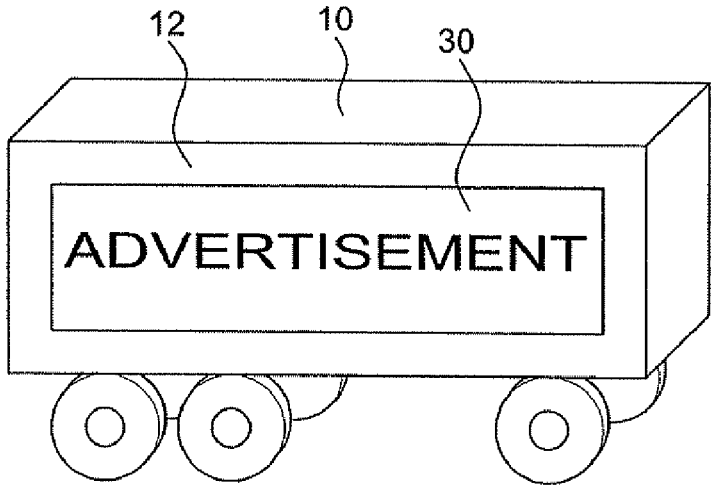
FIG. 1 is a perspective view of a display panel mounted on a vehicle or trailer in accordance with an embodiment of the present disclosure.

In the various figures, similar elements are identified with the same reference numbers. It should be noted that the drawing figures are not necessarily drawn to scale, but instead are drawn to provide a better understanding of the components thereof, and are not intended to be limiting in scope, but rather provide exemplary illustrations.

DETAILED DESCRIPTION OF VARIOUS EMBODIMENTS

As shown in FIG. 1, a display panel 30 is mounted to the exterior of a vehicle or vehicle trailer 10. The vertical sidewall of the vehicle acts as the mounting surface 12. It will be recognized that other mounting surfaces, such as walls and billboards, may be used, as will be discussed further below.

The display panel 30 is a substantially non-permeable flexible sheet. Any suitable sheet may be provided that is capable of receiving and retaining a printed face or other indicia. An exemplary display panel 30 is formed as a vinyl sheet. Of course any suitable material may be used, such as PES (polyethersulfone) fabric coated on both sides with PVC (polyvinylchloride) and having a matt lacquer applied to the printed side. Further, a semi-permeable flexible sheet may also be used. It will also be recognized that a display panel formed of wood, metal, or any other material that graphics may be printed upon, may be utilized. Specifically, the discussion below is not limited to flexible materials, but also encompasses semi-rigid and rigid materials.

Figure 2:
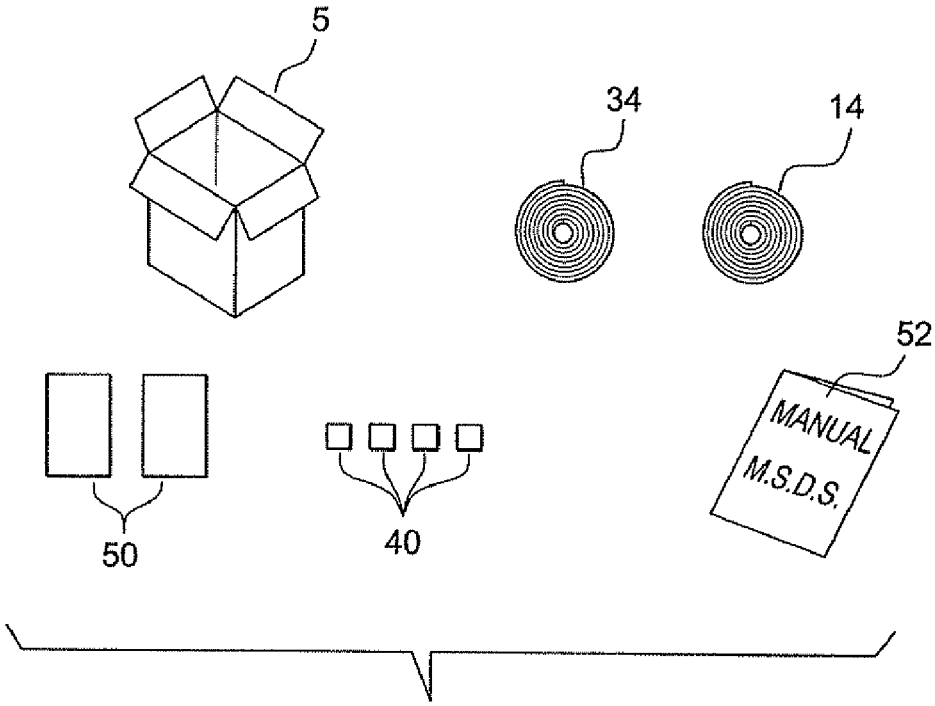
FIG. 2 is an exploded view of a kit for mounting a display panel according to an embodiment of the present disclosure.

A kit 1, as seen in FIG. 2, is provided for mounting the display panel 30 to a surface or substrate. The kit 1 includes a container 5, such as a cardboard or plastic box, for receiving the components of the kit 1 therein. The components include first 34 and second 14 primary releasable attachment elements, which together form the main frame for mounting the display panel 30 to a substrate. The kit 1 further includes at least one packet of activating wipes 50 and the manual and MSDS 52 (Material Safety and Data Sheet) for the kit 1. The packet of activating wipes includes a wipe with 6 mL of activator, which promotes adhesion. Of course, the packet of activating wipes may include wipes with any amount of activator, such as any amount up to 10 mL. Packets having wipes containing greater than 10 mL may be used, however, additional safety and shipping requirements must be met. Thus, according to the exemplary embodiment, the kit 1 may be easily sent through regular mail channels without requiring indicia that the container 5 includes hazardous materials therein.

Also included in the kit is at least one supplementary fastening element 40 having a stiff, rigid, semi-rigid, or flexible core and that acts as a spacer element. The supplementary fastening element 40 is a securing element that provides secure supplementary mounting between a display panel and a mounting surface in addition to the first and second primary releasable attachment elements. Since the first and second primary releasable attachment elements are selectively engageable with each other, there is the possibility that they may become disengaged at inappropriate times, such as when a vehicle is traveling on the highway. Thus, the supplementary fastening element 40 provides a secure supplementary mounting between a display panel and a mounting surface in addition to the first and second primary releasable attachment elements to prevent inadvertent disengagement of the first and second primary releasable attachment elements.

The supplementary fastening element 40 may be formed from any suitable material, such as ABS, PVC, metals, plastics, carbon fiber epoxy composites, or glass fiber epoxy composites. The supplementary fastening element 40 may be a stiff material, such as a material that is resistant to bending. While the supplementary fastening element 40 is shown having a square shape, it will be recognized that any suitable shape may be used, such as circular, oval, rectangular, parallelepiped, or any n-sided shape, where n is an integer.

Figure 7:
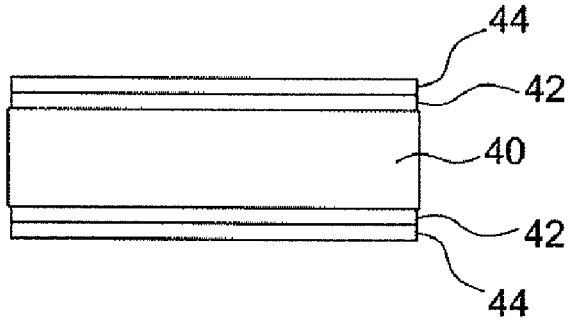
FIG. 7 is a side view of a supplementary fastening element in accordance with the present disclosure.

As shown in FIG. 7, the supplementary fastening element has first and second substantially planar surfaces. The surfaces are for the most part planar, while allowing for minor out of plane deviations due to manufacturing and processing limitations. These surfaces define the contact areas for respective attachment to the display panel and the mounting surface in a manner to be discussed below. It will be recognized that the surface areas of the supplementary fastening element may be any suitable size, for example approximately 1 and ½ inches by 1 and ½ inches, or 2 and ¼ inches square. Of course any larger or smaller area may be utilized within the scope of this disclosure.

In order to secure the supplementary fastening element 40 to the mounting surface 12 and the display panel 30, an adhesive is provided on each of the first and second substantially planar surfaces of the supplementary fastening element 40. The adhesive may be a double-sided tape 42 having a protective sheet 44 thereon in order to avoid inadvertent securement of the supplementary fastening element 40 to any surface. The protective sheet 44 is simply removed when a user wishes to secure the supplementary fastening element 40 to the mounting surface 12 and the display panel 30. An exemplary double-sided tape may be VHB™ Tape which does not degrade or erode the vinyl of the display panel 30.

While the double sided tape 42 is shown on both of the first and second substantially planar surfaces of the supplementary fastening element, any other suitable attachment mechanism may be utilized. Further, different attachment mechanisms may be utilized for each surface. For example, a mechanical fastener, such as a screw or bolt, may be used to secure the supplementary fastening element 40 to the mounting surface 12 and the double-sided tape 42 may be used to secure the supplementary fastening element 40 to the display panel 30. Other suitable attachment mechanisms include, but are not limited to, welding, bonding, and sewing.

As mentioned above, first and second primary releasable attachment elements 34, 14 are included in the kit 1. As shown, the first and second primary releasable attachment elements 34, 14 are lengths of material that are rolled up in order to reduce the amount of space that they occupy in the container 5. Of course, the first and second primary releasable attachment elements 34, 14 are not required to be in a rolled up configuration. The kit 1 may include appropriately predetermined lengths of both the first and second primary releasable attachment elements 34, 14, depending upon the size of the display panel to be mounted. A plurality of supplementary fastening elements 40 may be provided in the kit 1, in correspondence with the size of a display panel.

For example, when the system is used for mounting a display panel to a vehicle that will be traveling at highway speeds, the following exemplary numbers and positions of supplementary fastening elements 40 may be utilized. For display panels that are between 5 and 10 feet in width, two supplementary fastening elements 40 may be positioned along the top at each corner. For display panels that are between 12 and 20 feet in width, two supplementary fastening elements 40 may be positioned along the top at each corner, along with a third supplementary fastening element 40 equally spaced therebetween. For display panels that are between 12 and 36 feet in width, two supplementary fastening elements 40 may be positioned along the top at each corner, along with a third and fourth supplementary fastening element 40 equally spaced therebetween. For display panels that are between 40 and 53 feet in width, two supplementary fastening elements 40 may be positioned along the top at each corner, along with a third, fourth, and fifth supplementary fastening element 40 equally spaced therebetween.

For display panels that are between 2 and 5 feet in height, two supplementary fastening elements 40 may be positioned along the front at each corner. For display panels that are between 6 and 10 feet in height, two supplementary fastening elements 40 may be positioned along the front at each corner, along with a third and fourth supplementary fastening element 40 equally spaced therebetween. For display panels that are between 2 and 10 feet in height, two supplementary fastening elements 40 may be positioned along the rear at each corner.

Exemplary numbers and positions of supplementary fastening elements 40 may be utilized for mounting display panels to walls and other stationary mounting surfaces as follows. For display panels that are between 3 and 14 feet in length or height, four supplementary fastening elements 40 may be positioned at each corner. For display panels that are between 16 and 22 feet in length or height, four supplementary fastening elements 40 may be positioned at each corner, along with an additional supplementary fastening element 40 equally spaced along each side between the corners. For display panels that are between 24 and 36 feet in length or height, four supplementary fastening elements 40 may be positioned at each corner, along with two additional supplementary fastening elements 40 equally spaced along each side between the corners. For display panels that are between 40 and 53 feet in length or height, four supplementary fastening elements 40 may be positioned at each corner, along with three additional supplementary fastening elements 40 equally spaced along each side between the corners.

Of course, the above mentioned numbers and positions of the supplementary fastening elements 40 are merely exemplary, and any other suitable configuration and number of supplementary fastening elements 40 may be utilized as appropriate.

Figure 9:
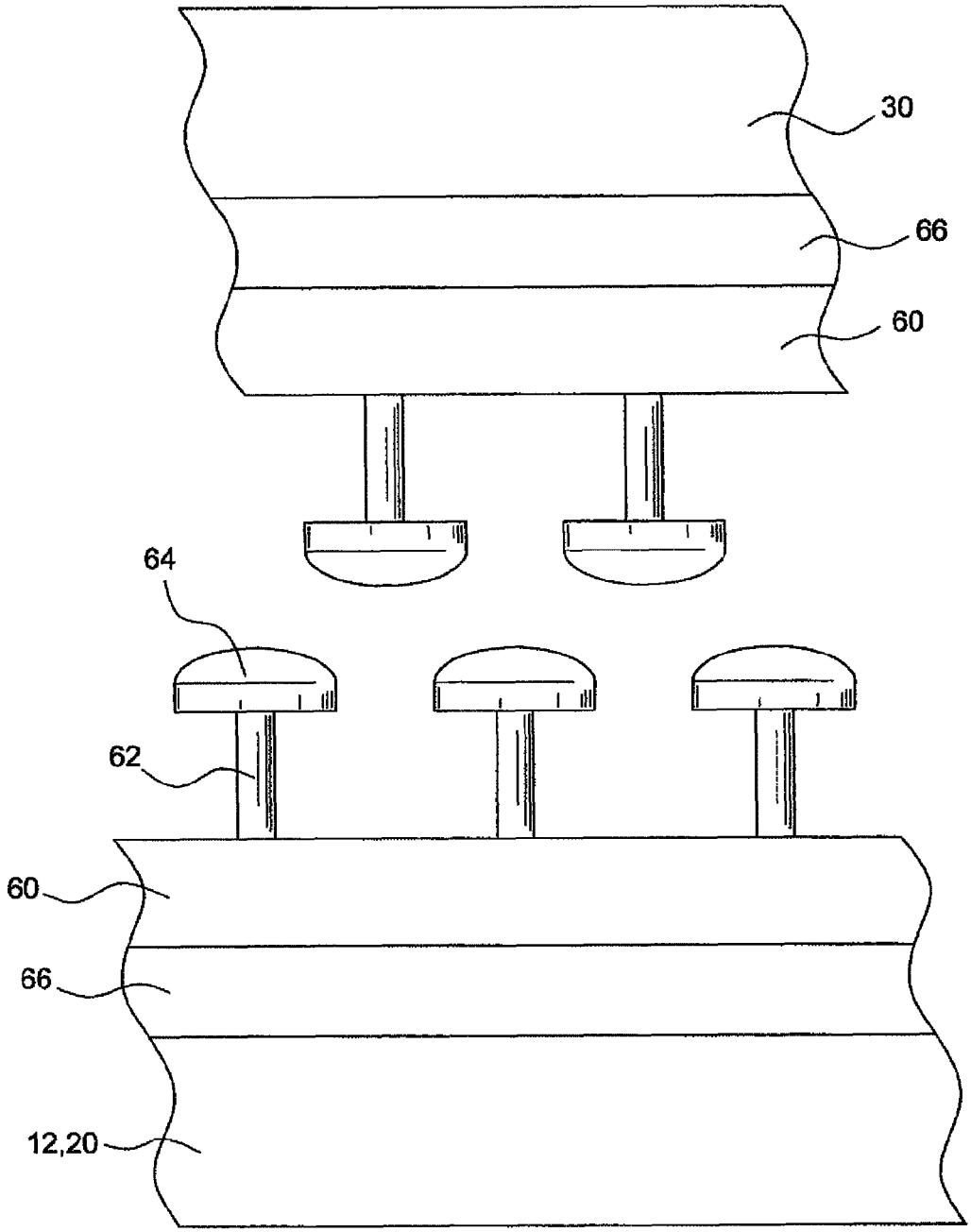
FIG. 9 is a partial side view of the first and second primary releasable attachment elements prior to engagement in accordance with the present disclosure.
Figure 10:
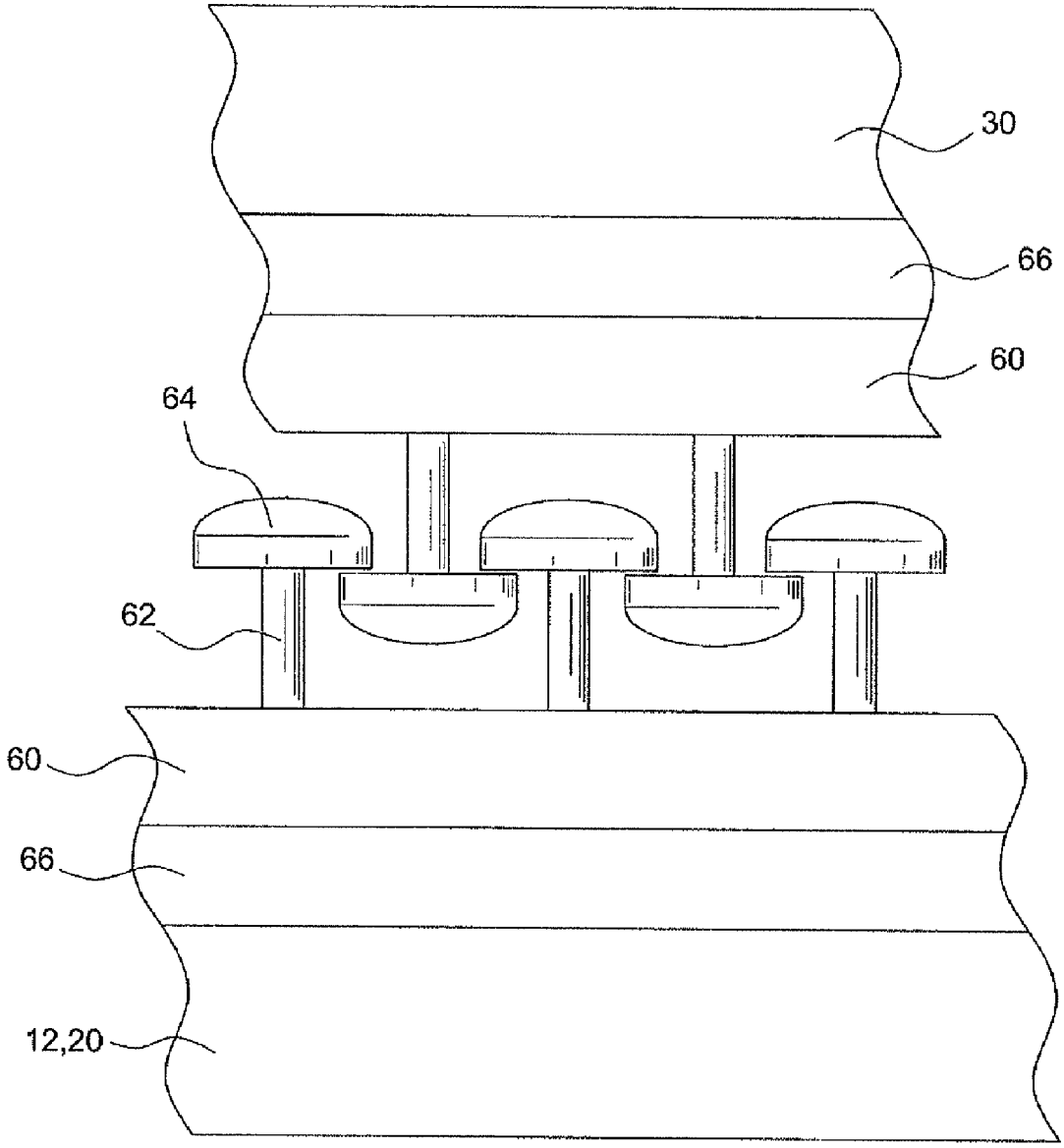
FIG. 10 is a partial side view of the first and second primary releasable attachment elements after engagement in accordance with the present disclosure.
Figure 11:
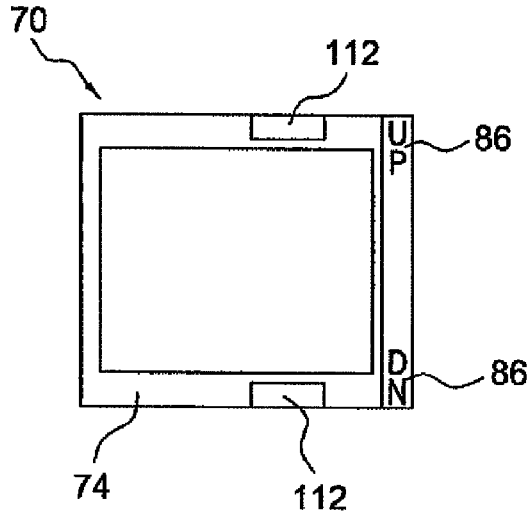
FIG. 11 is a front view of another embodiment of a supplementary fastening element in accordance with the present disclosure.
Figure 12:
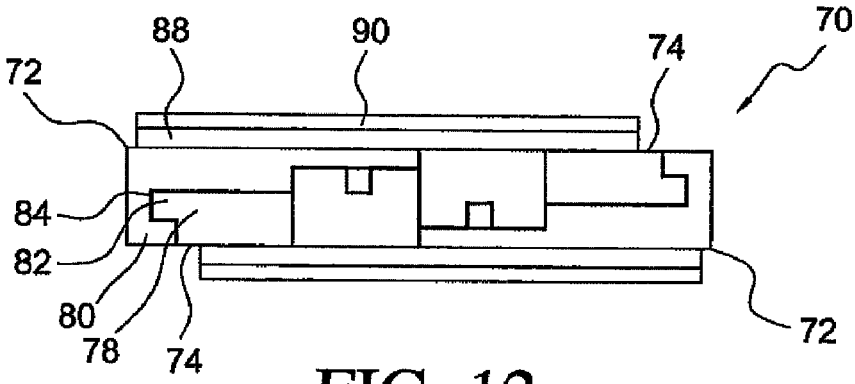
FIG. 12 is a bottom view of the supplementary fastening element of FIG. 11.

The first and second primary releasable attachment elements 34, 14 may be lengths of Dual Lock™ or any other suitable attachment elements, which may also include a matching length of double-sided adhesive tape 66, as shown in FIGS. 9 and 10, similar to the tape 42. Other adhesives, such as acrylic or pressure sensitive adhesives may also be used. Of course, any suitable primary releasable attachment element may be utilized, such as any form of hook and loop fastener, or any suitable mechanical fastener. With the use of Dual Lock™ for the first and second primary releasable attachment elements 34, 14, a piece of wax paper may be included in the kit 1 between stacked rolls of the first and second primary releasable attachment elements 34, 14 in order to prevent adhesion between the first and second primary releasable attachment elements 34, 14.

Figure 8:
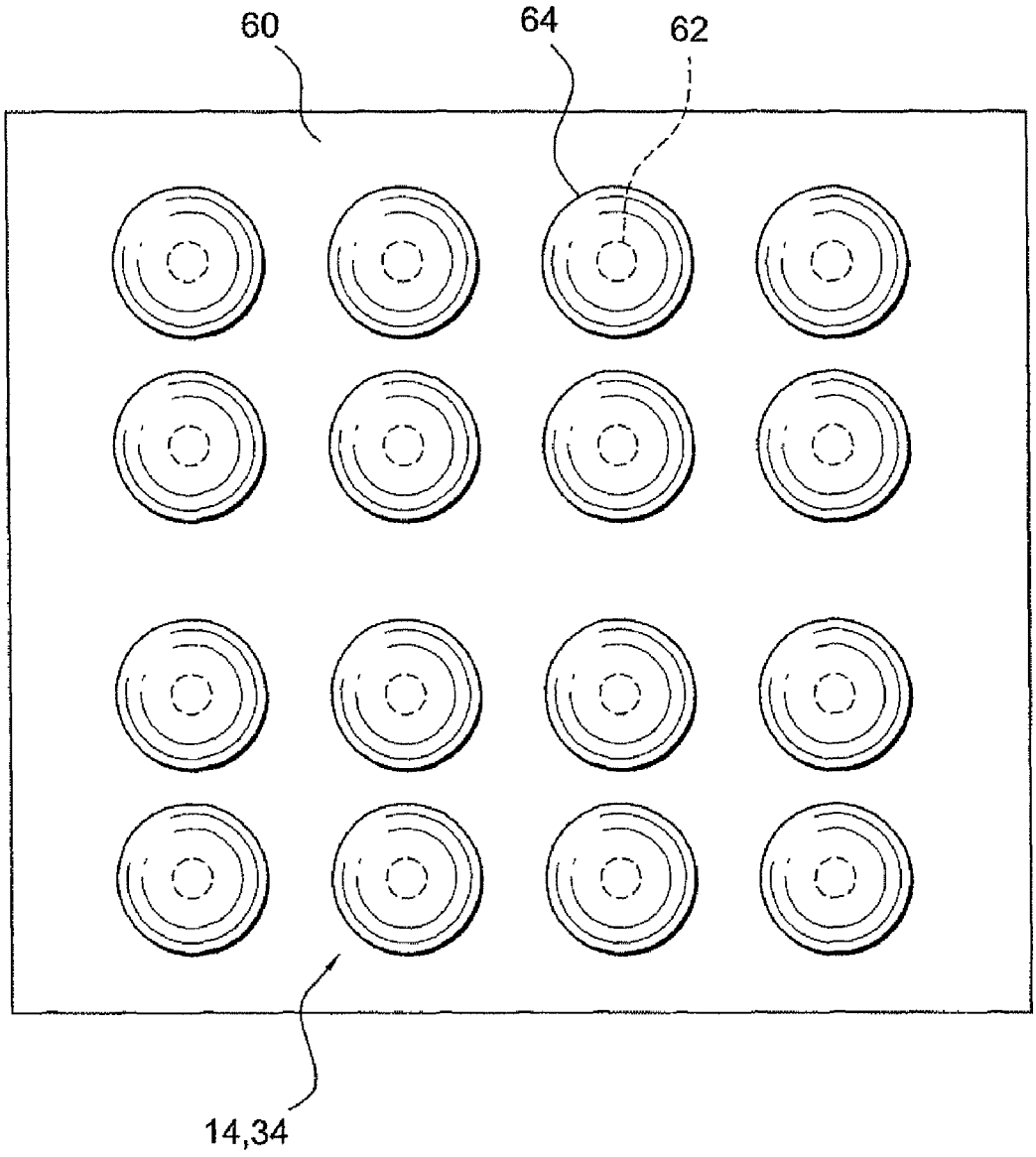
FIG. 8 is a schematic plan view of a primary releasable attachment element in accordance with the present disclosure.

As can be seen in FIGS. 8-10, each of the first and second primary releasable attachment elements includes a substrate 60 which carries a plurality of periodically spaced posts 62. Each post 62 includes a head 64, such that when two substrates 60 are brought into contact with each other, the posts 62 and heads 64 interlock in order to engage the two substrates together, as can be seen best in FIG. 10.

Figure 3:
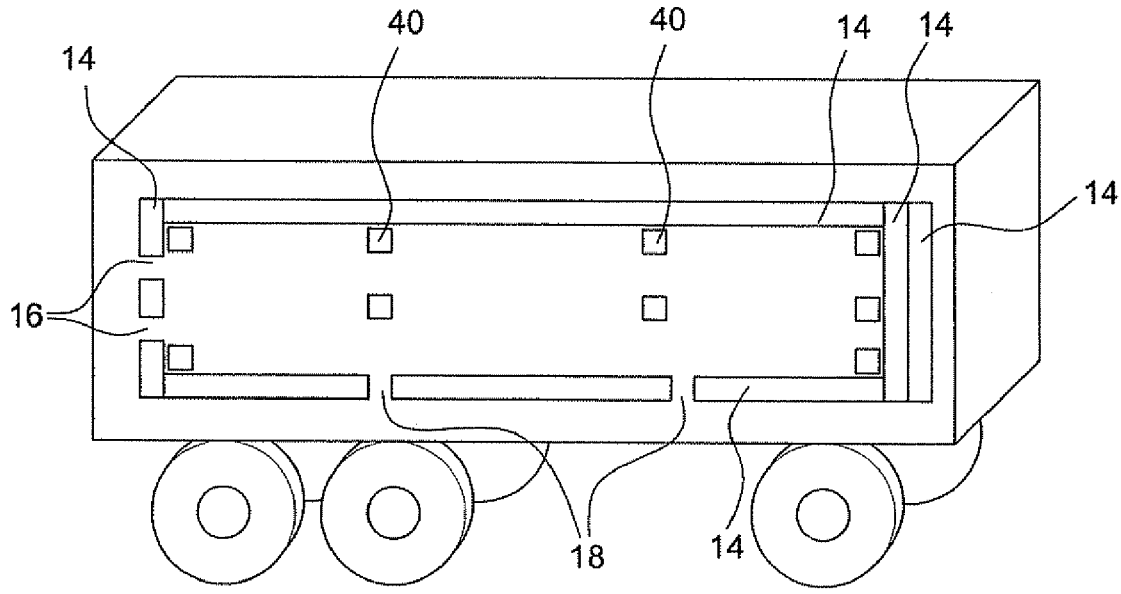
FIG. 3 is a perspective view of a primary releasable attachment element secured in an exemplary pattern to a vehicle or trailer in accordance with the present disclosure.

The method of using the display panel mounting system is now described in reference to FIGS. 3-6. As shown in FIG. 3, a vehicle 10 includes sidewalls that define a mounting surface 12. Prior to mounting the display panel 30 onto the mounting surface 12, the surface is cleaned with an appropriate solvent, such as Isopropyl alcohol mixed with 50% water. The surface may then be slightly abraded using any suitable tool, such as an abrasive pad.

The length of the second primary releasable attachment element 14 is appropriately cut and trimmed in order to match the outline of the display panel 30. The surface 12 is treated with the activator wipes in order to aid the curing or bonding of the second primary releasable attachment element 14 to the surface 12. The activator wipes include a compound or material that is used to smooth over or fill in small gaps or holes in the surface 12 in order to provide more surface area to improve adhesion. As shown in FIG. 3, the second primary releasable attachment element 14 is secured to the surface 12 in an exemplary pattern or outline that substantially matches the outline of the periphery of the display panel 30. While the pattern shown in FIG. 3 is formed by segmented strips and includes gaps, it will be understood that the word "pattern" refers to a general outline or configuration, and thus the pattern may be formed by continuous or segmented portions, or any other suitable arrangement of the primary releasable attachments.

As also shown in FIG. 3, two strips of the second primary releasable attachment element 14 are arranged in parallel adjacent to each other towards the front of the trailer or vehicle. This element provides additional support to the frame in order to counteract the effect of wind resistance on the frame and display panel 30 while the vehicle is in motion. As an additional precaution, the layout or pattern of the second primary releasable attachment element 14 alternates with the layout or pattern of the first primary releasable attachment element 34, as will be discussed in more detail below.

Further, gaps 16 may be provided in the section of the second primary releasable attachment element 14 that is towards the rear of the vehicle in order to allow any air that is trapped between the surface 12 and the display panel 30 to escape. Thus, billowing of the display panel 30 is avoided. Drainage gaps 18 may be positioned along the section of the second primary releasable attachment element 14 that is along the lower portion of the vehicle in order to allow any moisture or condensation that is trapped between the surface 12 and the display panel 30 to escape.

Figure 4:
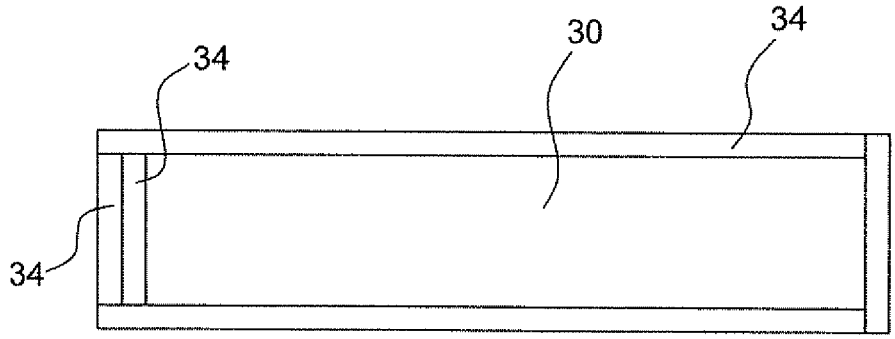
FIG. 4 is a side view of a primary releasable attachment element secured in an exemplary pattern to a display panel in accordance with the present disclosure.

As can be seen in FIG. 4, the first primary releasable attachment element 34 is secured in an exemplary pattern about the periphery of the display panel 30 in a corresponding manner to the second primary releasable attachment element 14. In order to provide additional support and structure for a vinyl banner type display panel 30, no gaps are provided in the first primary releasable attachment element 34 about the periphery of the display panel 30. However, gaps may be provided if desired, or if display panels that are rigid or semi-rigid and that can sufficiently support themselves are utilized. For example, gaps may be provided in sections of the first primary releasable attachment element 34 that correspond to the same sections in the second primary releasable attachment element 14, thus completing the air and moisture passageways.

The surface of the display panel 30 may also be cleaned with an appropriate solvent or cleaner and/or treated with the activating wipes, in the same manner as discussed above, prior to securing the first primary releasable engagement 34 element to the display panel 30. It is understood that the first primary releasable attachment element 34 may be arranged in a pattern, as pattern is defined above with respect to the second primary releasable attachment element 14. In particular, the pattern of the first primary releasable engagement 34 may be formed in a continuous or segmented manner, or in any other suitable configuration.

Figure 5:
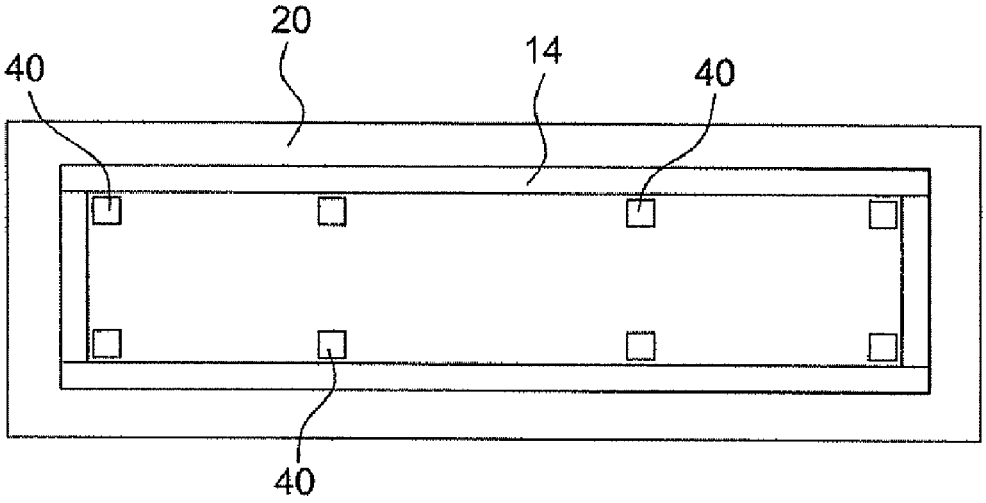
FIG. 5 is side view of a primary releasable attachment element secured in an exemplary pattern to a substrate, such as a wall or billboard, in accordance with the present disclosure.
Figure 6:
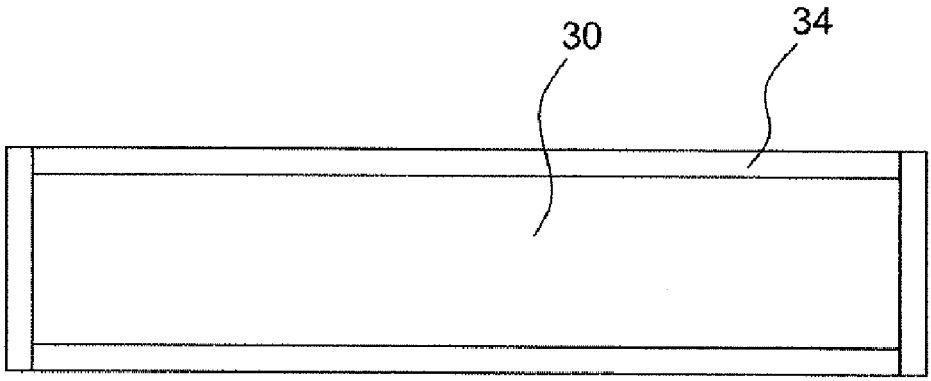
FIG. 6 is a side view of a primary releasable attachment element secured in an exemplary pattern to a display panel in accordance with the present disclosure.

As can also be seen in FIGS. 3 and 4, the sections of the first and second primary releasable attachment elements 34, 14 alternate between the mounting surface 12 and the display panel 30. Specifically, on the mounting surface 12, the forward and rear sections of the second primary releasable attachment element 14 extend and abut the ends of the upper and lower sections of the second primary releasable attachment element 14. In contrast, on the display panel 30, the upper and lower sections of the first primary releasable attachment element 34 extend and abut the ends of the forward and rear sections of the first primary releasable attachment element 34. This element forms an interlocking structure that aids in preventing the accidental removal of the display 30 from the mounting surface 12. Of course, any suitable alternating element may be used. As illustrated in FIGS. 5 and 6, the alternating element is modified to be the converse of that shown in FIGS. 3 and 4.

Prior to attaching the display panel 30 to the mounting surface 12, supplementary fastening elements 40 are secured to the mounting surface 12. The thickness of the supplementary fastening elements 40, and the associated double sided adhesive tape 42 for each side, is appropriately sized such that when the display panel 30 is mounted to the mounting surface 12, the supplementary fastening elements 40 engage the display panel 30 without extending beyond or through the surface of the display panel 30.

The supplemental fastening elements 40 may be mounted in any suitable arrangement within or about the patterns of the first and second primary releasable attachment elements 34, 14 in order to increase the safety and effectiveness of the display mounting system. Of course, as used herein, the word "within" applies to any configuration that literally is encompassed between the patterns of the first and second primary releasable attachment elements 34, 14, and any configuration that is adjacent or near to the first and second primary releasable attachment elements 34, 14, but that is not literally encompassed between the patterns of the first and second primary releasable attachment elements 34, 14.

For example, an appropriate number of fastening elements 40 may be mounted in equally spaced increments adjacent to the upper, front, and rear sections of the first and second primary releasable attachment elements 34, 14. Additional fastening elements 40 may be mounted along a middle portion of the display panel, as also shown in FIG. 3. The protective sheet 44 on the second side of the fastening element 40 is removed, and the adhesive tape 42 is secured to the mounting surface 12. This process is repeated for each supplemental fastening element 40.

Once all of the supplemental fastening elements 40 have been secured to the mounting surface, the protective sheets 44 on the first side of the fastening elements 40 may be removed and the first and second primary releasable attachment elements 34, 14 are brought into interlocking engagement with each other in order to mount the display panel 30 onto the mounting surface 12. Due to the thickness of the frame defined by the interlocked first and second primary releasable attachment elements 34, 14, a gap is formed between the display panel 30 and the mounting surface 12. The fastening elements 40 act as spacers within the gap to provide additional stability and support to the frame defined by the interlocked first and second primary releasable attachment elements 34, 14.

To complete the mounting of the display panel 30, the surface of the display panel facing the gap is secured to the first substantially planar surface of the fastening elements 40 in order to provide the additional securing mechanism of the display mounting system that does not increase the width of a trailer or vehicle beyond the 102.36 inches allowed by law.

The embodiment of FIGS. 5 and 6 also show an example of utilizing the display panel mounting system on any suitable substrate 20 such as a wall or billboard. The method of mounting the display panel 30 to the substrate 20 is the same in almost every respect as described above. However, due to the lack of wind resistance caused by motion of a vehicle, since walls and billboards are stationary objects, the two parallel strips of the first and second primary releasable attachment elements 34, 14, and the gaps 16, 18, 36, 38 are not necessary, although the drainage gaps 18, 38 may still be provided. Additionally, an alternative arrangement of the supplemental fastening elements 40 is shown in FIG. 5.

As previously discussed, any suitable number or arrangement of supplemental fastening elements 40 may be used. For example, a single large supplemental fastening element 40 may be provided centered in the middle portion of the display panel 30.

A variation of a supplemental fastening element 70 is shown in FIGS. 11-17. The supplemental fastening element 70 is composed of two component pieces 72 that are symmetrical to each other and are configured to selectively engage each other to create a stiff core supplemental fastening element for use as described above. The dimensions of the supplemental fastening element 70 can be any suitable dimensions. In an exemplary configuration, the supplemental fastening element 70 has approximate dimensions of 1.5 inches high, 1.6875 inches wide, and 0.15625 inches thick (without taking into account fastening mechanisms attached thereto). Of course, any suitable sizes are contemplated, including sizes discussed above.

As best shown in FIGS. 12, 13, 16, and 17, in order to provide secure selective engagement between the component pieces 72, each component piece 72 includes a base structure having a first, baseline thickness from which the remaining features of the component piece extend or are recessed. Each component piece 72 also has a first side 78 that defines a tongue structure 82 along the first side 78. The tongue structure 82 is complementary configured to be slid into a groove structure 84 defined along a second side 80 of a corresponding component piece 72, wherein each component piece 72 includes the second side 80 and the groove structure 84.

Figure 16:
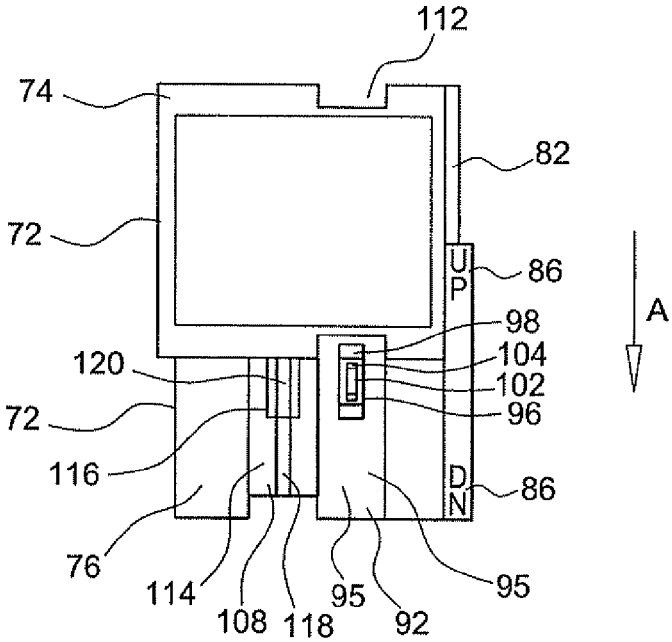
FIG. 16 is a front view showing the assembly of the two component pieces that make up the supplementary fastening element of FIG. 11.

As is illustrated in FIG. 16, two complementary shaped component pieces 72 are slid along direction A with the tongue structures 82 and the groove structures 84 in engagement with each other. In this manner, the two complementary shaped component pieces 72 can be selectively engaged with each other to form the supplemental fastening element 70. In order to disengage the two complementary shaped component pieces 72, they are slid in the direction opposite to direction A in order to separate the two complementary shaped component pieces 72.

As best seen in FIGS. 11, 14, 16, and 17, indicia 86 are provided along the second side 80 of each component piece 72 on the structure defining the groove 84. Of course, it will be recognized that the indicia 86 can be positioned in any suitable location on the component pieces 72. The indicia 86 can be used as directional or orientation indicia to provide a user with information on how the component pieces 72 are to be positioned with respect to a mounting surface and/or a display panel/surface. For example, the indicia may be directional arrows or phrases or abbreviations indicating direction, such as "UP" and "DN," or any other suitable indicia.

As shown in FIGS. 11-13, 15, and 16, each component piece 72 also has a first face 74 extending between the first and second sides 78, 80. The first face 74 is substantially planar and carries an attachment mechanism, such as a double sided adhesive 88 having a protective peel off layer or sheet 90. The double sided adhesive can be of any suitable type, or of any type discussed above. It will be recognized that other suitable attachment mechanisms may be utilized, such as hook and loop fasteners, snap fasteners, or any other suitable attachment mechanism.

As best shown in FIGS. 13, 14, 16, and 17, each component piece 72 also includes a second, opposed face 76 extending between the first and second sides 78, 80, and which carries first and second connection structures 92, 108 that are respectively complementary shaped to the second 108 and first 92 connection structures of a corresponding component piece 72.

The first and second connection structures 92, 108 are configured to allow each component piece 92 to flex across the first and second faces 74, 76 during the selective engagement process, and also during the disengagement process. However, once the component pieces 92 are engaged with each other, they define a stiff core supplemental fastening element 70 that is used in a manner previously discussed to mount a display panel to a mounting surface. The selective engagement and disengagement will be discussed in further detail below.

Figure 13:
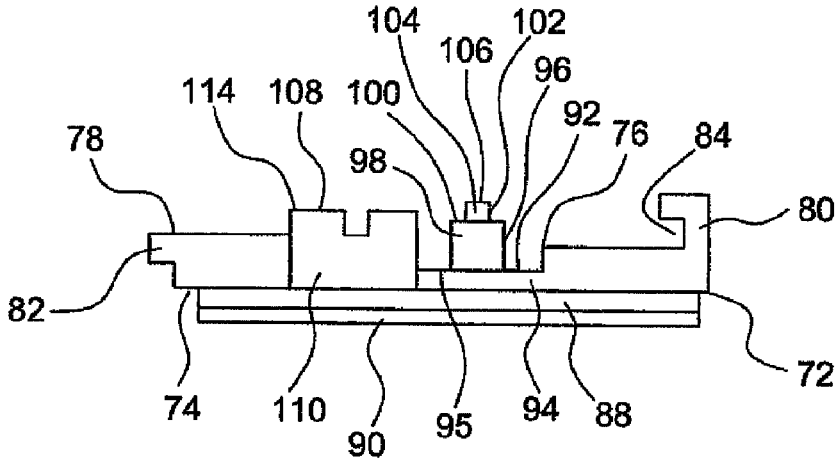
FIG. 13 is a bottom view of one of the two component pieces that make up the supplementary fastening element of FIG. 11.
Figure 14:
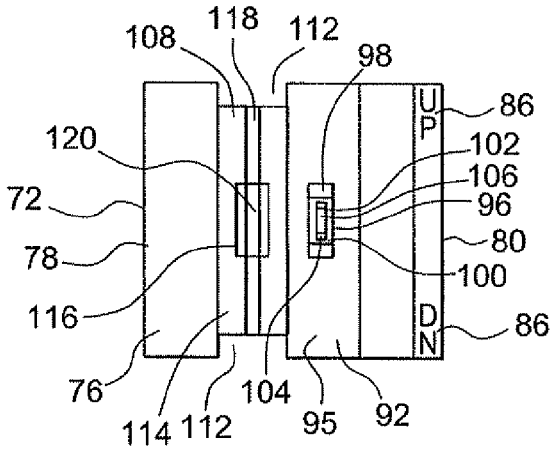
FIG. 14 is a front view of one of the two component pieces that make up the supplementary fastening element of FIG. 11.
Figure 15:
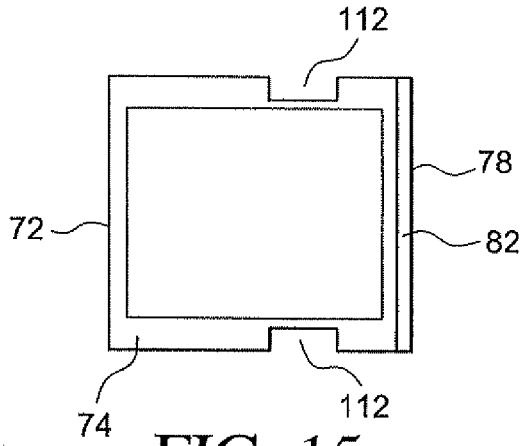
FIG. 15 is a rear view of the component piece of FIG. 14.
Figure 17:
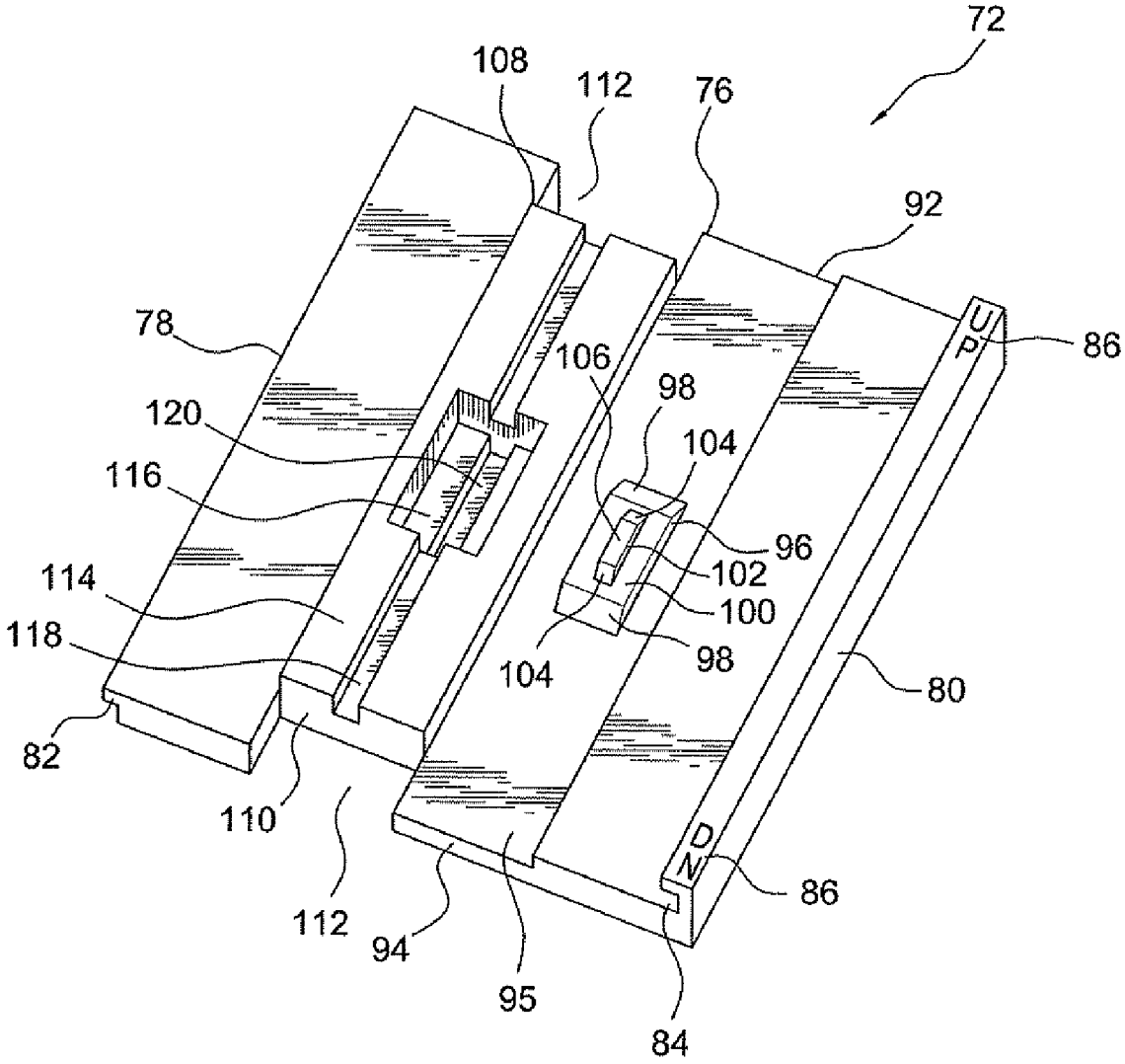
FIG. 17 is a front perspective view of the component piece of FIG. 14.

As best seen in FIGS. 13, 14, and 17, the first and second connection structures 92, 108 are composed of various features. In particular, the first connection structure 92 is defined by a reduced thickness portion 94 defined along the second face 76. The reduced thickness portion 94 defines a substantially planar sliding contact surface 95, the purpose of which is discussed below. A first projection 96 is generally centrally positioned along the reduced thickness portion 94. The first projection 96 includes opposed ramping surfaces 98 that each lead up to a substantially planar contact surface 100.

Positioned on the substantially planar contact surface 100 is a second projection 102 having opposed ramp surfaces 104 leading up to a contact surface 106. The second projection 102 has generally the same shape as the first projection 96, but a smaller size. The second projection 102 is generally centrally positioned on the contact surface 100.

The first and second projections 96, 102 are configured to cooperate with the features of the second connection structure 108, as discussed in detail below, in order to allow the selective engagement and disengagement of the component pieces 72 with each other.

The second connection structure 108 is positioned adjacent the first connection structure 92 and includes an increased thickness portion 110 that extends along the second face 76 between cutout sections 112. A sliding contact surface 114 is defined on the increased thickness portion 110 between cutout sections 112 defined in the base structure of the component piece 72.

As best seen in FIGS. 14, 16, and 17, a number of features configured to cooperate with, engage with, and receive the first and second projections 96, 102 of the first connection structure 92 are provided along or in the sliding contact surface 114 defined on the increased thickness portion 110. In particular, a receiving portion 116 for the first projection 96 is defined generally centrally located in the increased thickness portion 110. The receiving portion 116 has a shape generally corresponding to the shape of the first projection 96, so that the first projection 96 can be received therein when two component pieces 72 are brought together in engagement with each other.

As can be seen in FIGS. 13, 14, 16, and 17, a translating groove 118 is also defined along or in the sliding contact surface 114 defined on the increased thickness portion 110 for providing a sliding translation path for the second projection 102 when the two component pieces 72 are brought together into engagement with each other. The translating groove 118 connects with a receiving groove 120 defined in a bottom portion of the receiving portion 116, and which receives the second projection 102 therein when two component pieces 72 are brought together in engagement with each other.

In this manner, the features of the first and second connection structures 92, 108 provide interlocking structures that prevent inadvertent disengagement of the two component pieces 72, but do allow selective disengagement when a sufficient force is applied to the component pieces 72 in direction A or the direction opposite to direction A.

As will be understood from this description and in view of the drawings, the two component pieces 72 of the supplemental fastening element 70 are placed in selective engagement with each other via a sliding arrangement, as shown in FIG. 16. In particular, the tongues 82 of respective component pieces 72 are slid into engagement with the grooves 84 of the respective component pieces 72 to provide an initial coupling between the two component pieces 72.

The component pieces 72 are slid in the direction A such that the respective sliding contact surfaces 95, 114 of the first and second connection structures 92, 108 slide along each other until the ramp surfaces 98 of the first projection 96 come into contact with the edges of the increased thickness portions 110. As a sufficiently large force is applied to the component pieces 72, the ramp surfaces 98 of the first projection 96 cause the increased thickness portions 110 to slide upwards, thus flexing the component pieces 72 out of plane.

As the sliding contact surfaces 114 of the increased thickness portions 110 slide upwards over the ramp surfaces 98 and into sliding contact with the contact surfaces 100 of the first projections, the second projections 102 enter the translating grooves 118. As the component pieces 72 flex out of plane, the second projections 102 engage the sides of the translating grooves 118 to prevent the two component pieces 72 from becoming separated from each other due to the internal forces created by the flexing of the component pieces 72.

As the two component pieces 72 are further slid together, the first and second projections 96, 102 will eventually be received in the respective receiving portion 116 and receiving groove 120 to cause the two component pieces 72 to be locked together. When the first and second projections 96, 102 are received in the respective receiving portion 116 and receiving groove 120, the component pieces no longer flex out of plane, and a supplemental fastening element 70 having two substantially planar surfaces is provided.

To disengage the two component pieces 72, the process is reversed, with the ramp surfaces 98, 104 of the first and second projections 96, 102 allowing the first and second projections 96, 102 to be removed from the respective receiving portion 116 and receiving groove 120. Then, the two component pieces 72 flex out of plane, and can be slid apart in order to separate the two component pieces 72.

In use, the two component pieces 72 can be engaged with each other before being attached to the display panel and the mounting surface, or they may attached to the respective display panel and the mounting surface prior to being engaged with each other.

It is noted that at least one of the display panel and the mounting surface should be flexible enough to allow at least one of the two component pieces 72 to flex out of plane. If at least one of the display panel and the mounting surface is not flexible enough to allow at least one of the two component pieces 72 to flex out of plane, it will be difficult to disengage the two component pieces 72. However, if a more permanent connection is desired, there is no need for at least one of the display panel and the mounting surface to be flexible enough to allow at least one of the two component pieces 72 to flex out of plane.

It will of course be recognized that one or more of the supplemental fastening elements 70 can be utilized as standalone primary fastening elements for fastening display panels to a mounting surface, without the need for additional fastening elements described above.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various features from different embodiments. In addition to the variations described herein, other known equivalents for each feature can be mixed and matched by one of ordinary skill in this art to construct a display mounting system in accordance with principles of the present invention.

Although this invention has been disclosed in the context of certain exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims below.

I claim:

1. A component piece for use in a mounting system comprising:

a base structure having a first thickness, a tongue structure positioned along a first side thereof and a groove structure positioned along a second side thereof;

a substantially planar first face extending between the first and second sides and an opposed second face extending between the first and second sides; and the second face carries first and second connection structures;

wherein the first connection structure comprises:

a reduced thickness portion defined along the second face;

a first projection positioned along the reduced thickness portion; and a second projection positioned on the first projection.

2. A component piece according to claim 1, further comprising:

directional indicia positioned along the second side thereof.

3. A component piece according to claim 1, wherein the second connection structure comprises:

an increased thickness portion defined along the second face;

a receiving portion defined in the increased thickness portion;

a receiving groove defined in a bottom portion of the receiving portion; and a translating groove defined in the increased thickness portion.

4. A component piece according to claim 3, wherein the increased thickness portion is defined along the second face between opposed cutout sections defined in the base structure.

5. A component piece according to claim 1, further comprising:

first and second opposed ramp surfaces defined on the first projection; and first and second opposed ramp surfaces defined on the second projection.

6. A component piece according to claim 1, further comprising an attachment mechanism carried on the first face.

7. A fastening element for use in a mounting system comprising:

first and second selectively engageable component pieces, wherein each component piece comprises:

a base structure having a first thickness, a tongue structure positioned along a first side thereof and a groove structure positioned along a second side thereof;

a substantially planar first face extending between the first and second sides and an opposed second face extending between the first and second sides; and the second face carries first and second connection structures;

wherein each first connection structure comprises:

a reduced thickness portion defined along the respective second face;

a first projection positioned along the reduced thickness portion; and a second projection positioned on the first projection.

8. A fastening element according to claim 7, wherein each component piece further comprises:

directional indicia positioned along the respective second side thereof.

9. A fastening element according to claim 7, wherein each second connection structure comprises:

an increased thickness portion defined along the respective second face;

a receiving portion defined in the increased thickness portion;

a receiving groove defined in a bottom portion of the receiving portion; and a translating groove defined in the increased thickness portion.

10. A fastening element according to claim 9, wherein each increased thickness portion is defined along the respective second face between opposed cutout sections defined in the respective base structure.

11. A fastening element according to claim 7, wherein each component piece further comprises first and second opposed ramp surfaces defined on the respective first projection; and first and second opposed ramp surfaces defined on the respective second projection.

12. A fastening element according to claim 7, further comprising an attachment mechanism carried on each respective first face.

13. A display panel mounting system for mounting a display panel to a mounting surface, comprising:

first and second selectively engageable component pieces, wherein each component piece comprises:

a base structure having a first thickness, a tongue structure positioned along a first side thereof and a groove structure positioned along a second side thereof;

a substantially planar first face extending between the first and second sides and an opposed second face extending between the first and second sides;

the second face carries first and second connection structures; and an attachment mechanism carried on the first face;

wherein the attachment mechanism of the first component piece is engageable with a display panel and the attachment mechanism of the second component piece is engageable with a mounting surface;

wherein each first connection structure comprises:

a reduced thickness portion defined along the respective second face;

a first projection positioned along the reduced thickness portion; and a second projection positioned on the first projection.

14. A display panel mounting system according to claim 13, wherein each component piece further comprises:

directional indicia positioned along the respective second side thereof.

15. A display panel mounting system according to claim 13, wherein each second connection structure comprises:

an increased thickness portion defined along the respective second face;

a receiving portion defined in the increased thickness portion;

a receiving groove defined in a bottom portion of the receiving portion; and a translating groove defined in the increased thickness portion.

16. A display panel mounting system according to claim 15, wherein each increased thickness portion is defined along the respective second face between opposed cutout sections defined in the respective base structure.

17. A display panel mounting system according to claim 13, wherein each component piece further comprises first and second opposed ramp surfaces defined on the respective first projection; and first and second opposed ramp surfaces defined on the respective second projection.

* * * * *